United States Patent [19]

Yokoya et al.

[11] Patent Number: 4,535,470

[45] Date of Patent: Aug. 13, 1985

[54] AM STEREO DECODER FOR MULTIPLE CODING SYSTEMS

[75] Inventors: Satoshi Yokoya, Chofu; Norio Numata; Ikuo Shimizu, both of Tokyo, all of Japan

[73] Assignee: Sony Corporation, Tokyo, Japan

[21] Appl. No.: 492,269

[22] Filed: May 6, 1983

[30] Foreign Application Priority Data

May 27, 1982 [JP] Japan ..... 57-90364

[51] Int. Cl.[3] ..... H04H 5/00

[52] U.S. Cl. ..... 381/15

[58] Field of Search ..... 381/15, 16; 307/524; 329/140

[56] References Cited

U.S. PATENT DOCUMENTS

| | | | |
|---|---|---|---|
| 4,018,994 | 4/1977 | Kahn | 381/15 |
| 4,192,968 | 3/1980 | Hilbert et al. | 381/15 |
| 4,358,638 | 11/1982 | Numata et al. | 381/15 |
| 4,404,428 | 9/1983 | Hirata et al. | 381/15 |
| 4,426,728 | 1/1984 | Kahn | 381/15 |

FOREIGN PATENT DOCUMENTS

| | | | |
|---|---|---|---|
| 2022377 | 12/1979 | United Kingdom | 381/15 |

*Primary Examiner*—Gene Z. Rubinson

*Assistant Examiner*—W. J. Brady

*Attorney, Agent, or Firm*—Lewis H. Eslinger; Alvin Sinderbrand

[57] ABSTRACT

Decoding or demodulating circuitry can produce stereo right channel and left channel signals from AM stereo signals that have been coded according to any of the well known methods. A stereo sum signal made up of the left and right channel stereo signals added together, and a stereo difference signal made up of the difference between the stereo left and right channel signals are developed and fed to a matrix to interconnect these signals to extract or separate the left and right channel stereo signals. At least one of the known methods of stereo coding requires phase shifting of these two developed signals and suitable phase shift circuitry, along with a switching circuit provides the matrix with the appropriate signals when that method of stereo coding is employed at the broadcast side. The stereo sum signal is developed using envelope detection and the stereo difference signal is developed using synchronous detection, with the synchronous detector employing signals developed in the envelope detection process. When the stereo broadcasting wave belongs to the other coding systems, the stereo sum and difference signals are respectively supplied directly to the matrix circuit through the switches.

25 Claims, 2 Drawing Figures

AM STEREO DECODER FOR MULTIPLE CODING SYSTEMS

BACKGROUND OF THE INVENTION

1. Field of the Invention

The present invention relates generally to an amplitude modulation (AM) stereo receiver and, specifically, is directed to an AM stereo receiver for receiving and demodulating AM stereo signals broadcast according to various AM stereo broadcast schemes.

2. Description of the Prior Art

There have been several systems proposed for use in transmitting and receiving AM stereo radio broadcasts. All of the various systems were studied by the Federal Communications Commission (FCC) for approval, however, the FCC did not select any one system but approved five different AM stereo systems. The decision as to which system would ultimately prevail has been left to the marketplace. This has resulted in no one system coming to the fore as of yet, since no individual manufacturer has been willing to select one of the various AM stereo systems and make the investment necessary to produce receivers in quantity which could then receive signals broadcast according to only one of these different AM stereo systems. Presently the five most popular AM stereo systems are as follows:

(1) The AM-PM system, in which the carrier is amplitude modulated by a sum signal (L+R) made up of the stereo left and right signals L and R, respectively, and the carrier is then phase modulated by a difference signal (L−R) made up of the difference between the stereo left and right signals, respectively. This AM-PM system is described in U.S. Pat. No. 4,302,626.

(2) The AM-FM system, in which the carrier is amplitude modulated by the sum signal (L+R) and is also frequency modulated by the difference signal (L−R). This AM-FM system is described in U.S. Pat. No. 3,068,475.

(3) The C-QUAM (Compatible Quadrature Modulation) system in which two carriers that are of the same frequency but differ in phase by 90° are balance modulated with the left and right channel signals L and R, respectively, and are then added to each other to provide a phase modulation signal, which is then amplitude modulated by the sum signal (L+R). The C-QUAM system is described in U.S. Pat. No. 4,218,586.

(4) The VCPM (Variable-Angle Multiple Channel Modulation) system, in which orthogonal modulation is employed wherein the phase angle difference is controlled in response to the amplitude of the difference signal (L−R) from the left and right stereo signals. The VCPM system is described in U.S. Pat. No. 4,225,751.

(5) The ISB (Independent Side Band) system in which the sum and difference signals (L+R) and (L−R), respectively, of the stereo left and right channel signals are orthogonally modulated and are then passed through phase shifting circuits for phase shifting plus or minus 45° to form the signal of the ISB system. The ISB system is described in U.S. Pat. Nos. 3,218,393 and 4,018,994.

As seen from the above, these various systems are relatively complex but, more importantly, are all substantially different from each other, accordingly, there has not been available a receiver that can receive the AM stereo signals broadcast according to these different kinds of modulation schemes. That is, every present AM stereo receiver receives only a single kind of AM stereo broadcasts.

OBJECTS AND SUMMARY OF THE INVENTION

Accordingly, it is an object of the present invention to provide an AM stereo receiver that can receive and demodulate AM stereo signals broadcast according to various different kinds of AM stereo broadcasting schemes.

It is another object of the present invention to provide an AM stereo receiver having only a single demodulating circuit that can receive AM stereo signals that have been broadcast according to various ones of the different AM stereo broadcasting schemes or systems.

In accordance with one aspect of the present invention, an AM stereo receiver is provided that can receive the broadcasts of all of the various AM stereo systems now proposed. The AM stereo receiver according to the invention selects one of these several AM stereo systems as the fundamental system and employs switching circuitry to accomodate the other different kinds of AM stereo systems. For example, in one embodiment, the ISB system described above is selected as the fundamental or primary system and the AM stereo receiver receives the broadcasts of AM-PM, C-QUAM and VCPM systems with the demodulating circuit arranged in one configuration and receives the broadcasts of the ISB system with the demodulating circuit in another configuration. In this fashion, distortion generated upon receiving the AM-PM, C-QUAM and VCPM broadcast signals can be suppressed within tolerable limits and still provide sufficient separation to produce the stereo effect.

The above, and other objects, features and advantages of the present invention, will become apparent from the following description taken in conjunction with the accompanying drawings in which like reference numerals designate the same elements and parts.

DESCRIPTION OF PREFERRED EMBODIMENT

A review of all of the above-described presently proposed AM stereo broadcasting schemes reveals that each system is quite different in concept and theory than the other. Nevertheless, analyzing each type of AM stereo broadcasting system in detail has led to the determination that there exist certain points and features common to all of these systems and which provide the basis for the present invention. Representative of such common features are the following:

(1) Because the envelope of the carrier is modulated by the sum signal (L+R) in all cases with no distortion, it is possible that the sum signal can be detected or demodulated by the same kind of envelope detector in all of the variously proposed systems.

(2) Because the expansion of the output side band is compatible with the situation of the monaural AM system, all phase shifts must be less than one radian (middle band), one radian being approximately 58°.

(3) As a result of the one radian phase shift, described in (2) above, the difference signal (L−R), which is termed the sub-channel, of all systems can be demodulated by an orthogonal synchronous detector.

Figure 1:
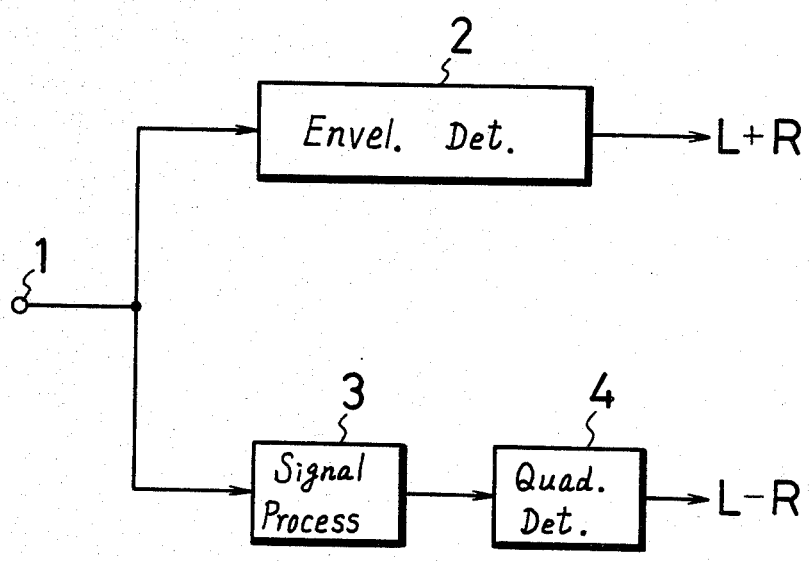
FIG. 1 is a block diagram showing a generalization of a portion of an AM stereo receiver.

For further analyzing these various common points, as they relate to the five different proposed systems described above, reference is made to FIG. 1 which shows a generalized embodiment of a decoder to permit a receiver to receive signals of all five different AM stereo systems, and in which an intermediate frequency (IF) signal derived from the received AM stereo signals may be applied to input terminal 1. The broadcast stereo signal is received in the standard way and reduced to its IF components using conventional circuits known to one with ordinary skill in the communications field. The IF signal is then fed to an envelope detector 2 of conventional configuration, which acts to detect or demodulate the IF signal to produce a sum signal (L+R) to be used in any of the above-noted stereo AM systems. The IF signal is also fed to a signal processing circuit 3 where it is processed in accordance with the particular kind of AM stereo broadcast being received, as hereinafter further described. The processed stereo signal is then demodulated or detected by quadrature or orthogonal synchronous detector 4 to form a resultant difference signal or subchannel signal (L−R). The actual process carried out by signal processor 3 will be different depending upon the kind of AM stereo broadcast signals being received.

For example, in the case of receiving signals broadcast according to the AM-PM and AM-FM schemes described above, signal processor 3 performs a multiplication by the factor $$\frac{1}{(1+L+R)}$$

to remove the AM component from the received signal.

In the case of the ISP system, signal processor 3 performs a multiplication by the modulation factor $$\frac{1}{1+0.5(L+R)}.$$

In the situation where the signals are broadcast in accordance with the C-QUAM system, a multiplication by the factor $$\frac{1}{\cos\phi}$$

is performed by signal processor 3 in order to remove a distortion correcting signal cos $\phi$, where $\phi$ is $\tan^{-1}$ $$\left(\frac{L-R}{1+L+R}\right),$$

which distortion correcting signal is multiplied with the quadrature modulation signal in order to be compatible with monaural broadcasting.

In the case where the AM stereo broadcasting scheme is the VCPM system, signal processor 3 effects multiplication of the variable gain factor G, where G is in the range of $3.7>G\geqq 1$, and is in proportion to the difference signal (L−R).

From the above it may be seen that the various systems for providing AM stereo broadcasts, as viewed from the standpoint of the decoder at the receiver, can be characterized by various non-linear parameters, which are multipliers of the sub-channel signal, and the remaining differences thereamong are only level and phase relationships that may be easily taken into account in the demodulation operation.

It is further to be seen that, in regard to the above parameters, the parameter of the VCPM system is in the form of a true multiplication, which could be readily achieved, but each of the other parameters is in the form of a division, which is a more difficult operation to accomplish when signal processing.

Generally, in accordance with the present invention, an AM stereo receiver that can receive signals that have been broadcast according to all of the various above-mentioned schemes for AM stereo radio takes one of these several stereo schemes, for example, the ISB system or scheme as the fundamental scheme, and receives the broadcast signals of the AM-PM, C-QUAM, and VCPM systems or schemes with its demodulating circuit in one configuration and, accordingly, is adapted to receive the broadcast signals of the ISB system by switching the demodulating circuit to another configuration. Thus, distortion generated upon the reception of the AM-PM, C-QUAM, and VCPM systems can be suppressed within acceptable tolerance levels and still provide separation sufficient to achieve the desired stereo effect.

One embodiment of an AM stereo receiver according to the present invention will now be described with reference to FIG. 2, in which an IF signal from the IF stage of the AM receiver (not shown), which is found in all conventional receivers and does not form a part of the present invention, is fed to an input terminal 11. This IF signal at terminal 11 is fed to an amplitude limiter 12 to provide a substantially constant amplitude IF signal. The output from the amplitude limiter 12 and the IF signal from input terminal 11 are fed to a balanced mixer or modulator 13 and are multiplied therein to produce the sum or additive signal (L+R) at the output of mixer 13. Amplitude limiter 12 and mixer 13 comprise one implementation of an envelope detector.

A phase-locked loop (PLL), shown generally at 14, includes a phase comparator 15, a low pass filter network 16, and a voltage controlled oscillator 17, whose output signal is fed back to the phase comparator 15. The output signal from amplitude limiter 12 and the output signal from voltage controlled oscillator 17 are fed to phase comparator 15 and are phase compared therein. The resultant error signal produced by the phase comparator 15 is then fed to low pass filter 16 and converted to the corresponding DC voltage used to control voltage controlled oscillator 17. This DC voltage from filter 16 causes voltage controlled oscillator 17 to adjust its output or, in other words, to adjust its frequency of oscillation in response to the amount of phase error, thereby producing a non-modulated carrier sin $\omega_c t$, which is the quadrature component. Low pass filter 16 includes a time constant circuit **16*a* that is formed of a capacitor 16*ac* and a resistor 16*ar* connected to a suitable voltage source. The time constant of this time constant circuit 16*a* is set to a value so that the bandwidth of the phase-locked loop 14** is narrow, for example about 70 Hz.

A signal divider 18 is provided to divide the IF signal fed thereto from terminal 11 by a predetermined divisor. This divisor is derived from the sum signal (L+R) produced at the output of balanced mixer 13. This sum signal produced by mixer 13 is voltage divided by resistors 19 and 20 and is fed to the divisor input of divider 18. The voltage dividing ratio of resistors 19 and 20 is preferably chosen as 0.5, which has been found to be an optimum value for the ISB system. A DC voltage source 21 is also connected to the divisor input of divider 18 and serves to supply the DC bias (+1 volt) thereto.

Another balanced mixer 22 is provided and is connected to receive the output signal of divider 18 and the output signal of phase-locked loop circuit 14. The output signal of phase-locked loop circuit 14 is represented by the output signal from voltage controlled oscillator 17 and is orthogonal to the output from divider 18. These signals are multiplied in mixer 22 to produce the difference signal (L−R), that is, the sub-channel signal. These circuit elements, including phase-locked loop circuit 14 and balanced mixer 22, then form the so-called phase-locked loop synchronous detector.

When it is desired to receive and decode the broadcasts according to the ISB stereo system, the output signals of mixers 13 and 22 are connected, respectively, to phase shift networks 23 and 24, each imparting a 45° phase shift. In other words, phase shift network 23 receives the sum signal (L+R) and the difference signal (L−R) is fed to phase shift network 24. These two phase shifting networks 23 and 24 are utilized only when the ISB stereo signals are being received. When stereo signals broadcast according to the other AM stereo schemes are received, it is necessary to bypass phase shift networks 23 and 24 and, accordingly, suitable switches are provided to accomplish such bypassing. Specifically, at the outputs of phase shift networks 23 and 24 are connected switch terminals of switches 25 and 26, respectively. These two switches 25 and 26 are mechanically ganged with each other so that mechanical actuation of one switch also results in actuation of the other switch. As shown in FIG. 2, each of switches 25 and 26 includes a movable contact c and two fixed contacts a and b. The movable contacts c of switches 25 and 26 are connected, respectively, to two input lines of a matrix circuit 27, and the fixed contacts a of switches 25 and 26 are connected, respectively, to the inputs of phase shift networks 23 and 24. These inputs to networks 23 and 24 represent the outputs from balanced mixers 13 and 22, respectively. The fixed contacts b of switches 25 and 26 are connected, respectively, to the outputs of phase shift networks 23 and 24. In the situation where AM stereo signals are being received that have been broadcast according to systems other than the ISB system, the movable contacts c of switches 25 and 26 are moved together out of contact with fixed contacts b and into contact with contacts a, whereas, when the received AM stereo signals which are to be decoded have been broadcast in accordance with the ISB system, switches 25 and 26 are actuated to engage movable contacts c with fixed contacts b of phase shift networks 23 and 24. In other words, the sum and difference signals (L+R) and (L−R), respectively, are both supplied either directly, or through phase shift networks 23 and 24, to matrix circuit 27, which acts to provide the appropriate switching interconnections to form a matrix of the inputs, thereby to produce separate left and right channel signals L and R, respectively, at output terminals 28 and 29.

Figure 2:
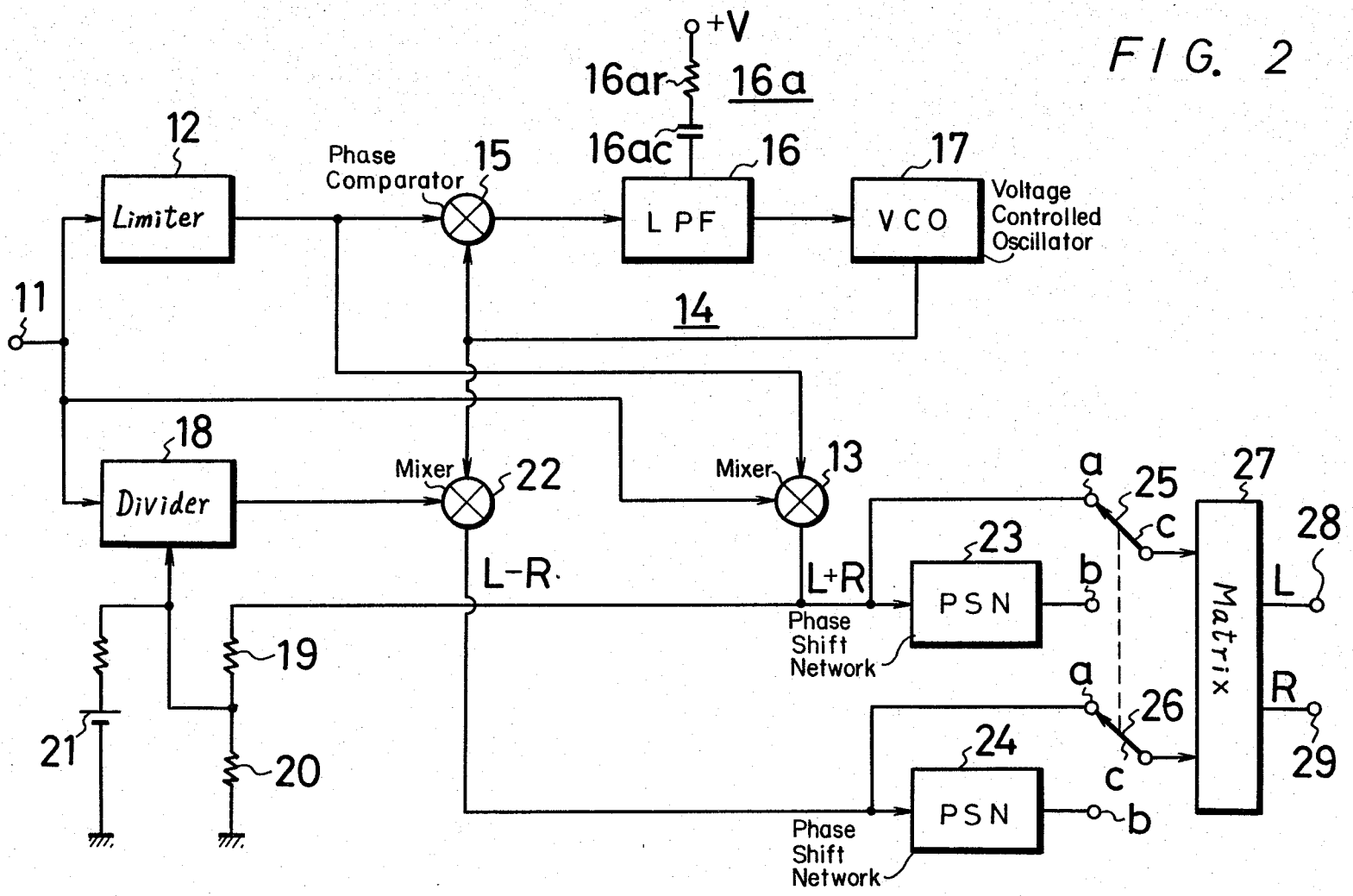
FIG. 2 is a schematic in block diagram form of an embodiment of an AM stereo receiver according to the present invention.

In operation of the inventive circuits shown in FIG. 2, when receiving any AM stereo signal broadcast according to the systems known as AM-PM, C-QUAM, and VCPM the movable contacts c of switches 25 and 26 are connected to fixed contacts a thereby bypassing phase shifting networks 23 and 24. When the AM stereo signal that is received has been broadcast according to the AM-PM system, the IF signal supplied to input terminal 11 can be expressed as follows:

$$(1+L+R)\cos\{\omega_c t+(L-R)\} \qquad \ldots (1)$$

The IF signal defined by expression (1) above is fed directly to one input of balanced mixer 13 and is also fed to the input of amplitude limiter 12 to produce a signal with constant amplitude, expressed as cos $\{\omega_c t+(L-R)\}$, and which is then fed to the other input of mixer 13. In other words, the output of mixer 13 is the left and right sum signal (L+R). The received IF signal set forth in expression (1) above is also fed to divider 18, wherein this IF signal is divided by the signal represented by 1+0.5(L+R) and the resultant output signal is then fed to balanced mixer 22. The other input of balanced mixer 22 is represented by the signal sin $\omega_c t$, which is obtained from phase-locked loop circuit 14 and, as indicated above, represents the quadrature component of the input signal fed into the loop. Accordingly, at the output side of balanced mixer 22 the difference signal (L−R) is obtained and may be expressed as follows:

$$\frac{1+L+R}{1+0.5(L+R)}\cos[\omega_c t+(L-R)\sin\omega_c t] = \qquad (2)$$

$$\frac{1+L+R}{1+0.5(L+R)}[\sin 2\omega_c t+\sin(L-R)] \approx$$

$$\frac{1+L+R}{1+0.5(L+R)}\sin(L-R)$$

If the difference signal (L−R) is assumed to be small in the above equation (2), then sin (L−R)÷(L−R) is established. Accordingly, expression (2) above may be rewritten as:

$$\frac{1+L+R}{1+0.5(L+R)}(L-R) \qquad (3)$$

In expressions (2) and (3), the term $$\frac{(1+L+R)}{1+0.5(L+R)}$$

represents the distortion component contained in the difference or sub-channel signal (L−R).

The sum signal (L+R) is applied through contacts a and of switch 25 to matrix circuit 27, while the difference signal approximated by expression (3) above is applied to matrix circuit 27 through contacts a and c of switch 26. In this fashion, left and right channel signals L and R are made available at output terminals 28 and 29, respectively, of matrix circuit 27.

When receiving AM stereo signals broadcast according to the C-QUAM system, the IF signal fed to input terminal 11 may be expressed as follows:

$$(1+L+R)\cos(\omega_c t+\phi) \qquad \ldots (4)$$

where $\phi=\tan^{-1}$ $$\left(\frac{L-R}{1+L+R}\right).$$

The IF signal of expression (4) above is fed directly to one input of balanced mixer 13 and is also fed to amplitude limiter 12 to form the constant amplitude signal expressed as cos $(\omega_c t+\phi)$, which is fed to the other input of balanced mixer 13. Once again, note that what is being accomplished here is envelope detection, and the output of the envelope detection is the sum signal (L+R) that is obtained from the output of mixer 13.

The IF signal of expression (4) above is also fed to divider 18, wherein the IF signal is divided by a signal represented by 1+0.5 (L+R) and the resultant signal of such division is fed to one input of balanced mixer 22. The other input of balanced mixer 22 is the output signal from phase-locked loop circuit 14, represented by sin $\omega_c t$, which is the quadrature component of the input signal. Accordingly, synchronous detection is performed and the difference signal is produced at the output of balanced mixer 22. This difference signal (L−R) may be expressed as follows:

$$\frac{1+L+R}{1+0.5(L+R)}\cos(\omega_c t+\phi)\sin\omega_c t = \tag{5}$$

$$\frac{1}{2}\cdot\frac{1+L+R}{1+0.5(L+R)}\cos\{\sin(2\omega_c t+\phi)+\sin\phi\} =$$

$$\frac{1}{2}\cdot\frac{1+L+R}{1+0.5(L+R)}\sin\phi =$$

$$\frac{1}{2}\cdot\frac{1+L+R}{1+0.5(L+R)}\cdot\frac{L-R}{\sqrt{(1+L+R)^2+(L-R)^2}} =$$

$$\frac{1}{2}\cdot\frac{\cos\phi}{1+0.5(L+R)}\cdot(L-R)$$

In expression (5) above, the distortion component contained in the difference signal (L−R) is the factor $$\frac{\cos\phi}{1+0.5(L+R)}.$$

The sum signal (L+R), produced by mixer 13, and the difference signal (L−R), produced by balanced mixer 22 and represented by expression (5) above, are fed to the respective inputs of matrix circuit 27 where they are switched appropriately to be separated and delivered to output terminals 28 and 29 as the left and right channel signals L and R, respectively, similar to the situation relative to the AM/PM system described above.

When the AM stereo signal to be received has been broadcast according to the VCPM system, the IF signal supplied at input terminal 11 may be expressed as follows:

$$(1+L+R)\cos\omega_c t+\left(\frac{L-R}{G}\right)\sin\omega_c t \tag{6}$$

where G is the gain factor satisfying the relationship $3.7>G\geqq 1$, when the controllable range of the phase angle difference is between 90° and 30°.

The IF signal represented at (6) above corresponding to the VCPM broadcast signal is fed directly to one input of mixer 13 and is also fed to amplitude limiter 12 to provide the constant amplitude signal fed to the other input of mixer 13. Envelope detection is then performed in mixer 13 and the output of mixer 13 is a signal expressed as follows:

$$\sqrt{(1+L+R)^2+\left(\frac{L-R}{G}\right)^2}=J \tag{7}$$

Simultaneously, the IF signal represented by expression (6) above is fed to divider 18. The other input signal to divider 18 is the divisor, which may be represented by 1+0.5J, in which J is determined from equation (7) above. The output signal of divider 18 is fed to one input of balanced mixer 22. The other input of balanced mixer 22 is the quadrature component derived from the phase-locked loop circuit 14, the quadrature component being represented by sin $\omega_c t$. In this fashion, as in the demodulations of the other kinds of AM stereo signals, synchronous detection is carried out and, thus, the output of balanced mixer 22 represents the difference signal (L−R) that may be expressed as follows:

$$\frac{(1+L+R)\cos\omega_c t\cdot\sin\omega_c t+L-R\sin^2\omega_c t}{1+0.5J} = \tag{8}$$

$$\frac{\frac{(L-R)}{G}(\sin^2\omega_c t+\cos\theta)}{1+0.5J}\approx$$

$$\frac{L-R}{1+\sqrt{(1+L+R)^2+\left(\frac{L-R}{G}\right)^2}}\cdot\frac{1}{G}$$

In the above equation (8), the term $$\frac{1}{1+\sqrt{(1+L+R)^2+\left(\frac{L-R}{G}\right)^2}}\cdot\frac{1}{G}$$

represents the distortion component that is present in the difference signal (L−R). Accordingly, the sum signal (L+R) obtained through envelope detection as the output of mixer 13 is fed through contacts a and c of switch 25 to one input of matrix circuit 27, and the difference signal (L−R) obtained through synchronous detection as the output of mixer 22 is fed through switch contacts a and c of switch 26 to the other input of matrix circuit 27, whereby the left and right channel signals L and R are obtained at the output terminals 28 and 29, respectively.

When it is desired to receive stereo amplitude modulated signals broadcast according to the ISB system, then switches 25 and 26 must be actuated to engage switch contacts b and c, respectively, in order to insert phase shift networks 23, 24 into the signal path. If it is assumed that the sum signal $(L+R)_{<-45°}$, which has been phase shifted by −45° at the broadcast station is represented as $X_-$, and the difference signal $(L-R)_{<+45°}$ which has been phase shifted by +45° at the broadcast station, is represented as $Y_+$, then the IF signal applied to input terminal 11 can be expressed as follows:

$$(1+X_-)\cos\{\omega_c t+Y_+(1-0.5X_-)\} \quad \ldots (9)$$

Once again, the IF signal represented by (9) above is fed directly to one input of mixer 13 as well as to amplitude limiter 12 in order to produce the signal expressed as $\cos\{\omega_c t+Y_+(1-0.5X_-)\}$, which is then fed to the other input of mixer 13. In this fashion, envelope detection is carried out and the sum signal $X_-$ delayed by 45°, as represented by $(L+R)_{<-45°}$ is the output of mixer 13. The IF signal expressed at (9) above is also simultaneously fed to the input of divider 18 where this IF signal is divided by a divisor represented by the signal $1+0.5X_-$. The output signal from divider 18 is then fed to mixer 22, which has as its other input the quadrature component $\sin \omega_c t$, which is the output from phase-locked loop circuit 14. Accordingly, the IF signal is quadrature-synchronous-detected with the quadrature component. The resultant signal at the output of mixer 22 is the difference signal (L−R) that may be expressed as follows:

$$\frac{(1+X_-)\cos\{\omega_c t+Y_+(1-0.5X_-)\}\cdot\sin\omega_c t}{1+0.5X_-} = \frac{(1+X_-)\sin\{Y_+(1-0.5X_-)\}}{1+0.5X_-} \quad (10)$$

In the above expression (10), representing the difference signal, if the value of the term $Y_+(1-0.5X_-)$ is assumed to be small, then the relationship $\sin\{Y+(1-0.5X_-)\}\div Y_+(1-0.5X_-)$ may be established. Following this assumption then the equation (10) above becomes:

$$\frac{(1+X_-)\cdot Y_+(1-0.5X_-)}{1+0.5X_-} = \frac{1+0.5X_- - 0.5X_-^2}{1+0.5X_-}\cdot Y_+ = \left(1-\frac{0.5X_-^2}{1+0.5X_-}\right)\cdot Y_+ \quad (11)$$

In this case, if the relationships $0.5X_-^2 << 1$ and $X_- < 0.5$ are satisfied, then the above expression at (11) may be expressed substantially as follows:

$$Y_+ = (L-R)_{<+45°} \quad \ldots (12)$$

In the difference signal $Y_+$, as set forth above at (12), the distortion component contained therein may be given by the following:

$$-\frac{0.5X_-^2}{1+0.5X_-}\cdot Y_+$$

that is derived from equation (11) above.

The summation signal $(L+R)_{<-45°}$ produced at the output of mixer 13 and the difference signal $(L-R)_{<+45°}$ produced at the output of mixer 22 are supplied, respectively, through the phase shifting networks 23 and 24 and switches 25 and 26 to the inputs of matrix 27, where they are suitably combined in the known manner. Thus, the left and right channel signals L and R are derived, respectively, at output terminals 28 and 29 of matrix unit 27.

Accordingly, as mathematically demonstrated in the above, the sum and difference signals may be obtained by use of the inventive circuitry of FIG. 2 by making certain approximations concerning the distortion present in the received AM stereo signals. Moreover, the actual distortion factor and separation of each of the various AM stereo broadcast systems described above can be calculated and the influences on the output signals determined. In making these calculations and determinations the form of the broadcast signal is represented as f(t) in each of the various kinds of stereo broadcast systems, is modified as follows, and is then Fourier-developed. Based upon the above discussion relative to FIG. 2 it may be seen that the sum signal (L+R) contains almost no distortion factors because of the straightforward approach to envelope detection, thus, no additional assumptions need be made. As to the difference signal (L−R), the above calculations are carried out assuming L=m cos and R=0, where the modulation degree m is 30%.

In the AM-PM system:

$$f(t) = \frac{1+m\cos\theta}{1+0.5m\cos\theta}\cdot\sin(m\cos\theta) \quad (13)$$

In the C-QUAM system:

$$f(t) = \frac{m\cos\theta}{1+0.5m\cos\theta}\cdot\cos\left\{\tan^{-1}\frac{m\cos\theta}{1+m\cos\theta}\right\} \quad (14)$$

In the VCPM system:

$$f_{L(t)} = \sqrt{(1+m\cos\theta)^2+(m\cos\theta/G)^2} + \frac{m\cos\theta}{1+0.5m\cos\theta}\cdot\frac{1}{G} \quad (15)$$

$$f_{R(t)} = \sqrt{(1+m\cos\theta)^2+(m\cos\theta/G)^2} - \frac{m\cos\theta}{1+0.5m\cos\theta}\ \frac{1}{G} \quad (16)$$

where $G=\cos\theta/2$ ($\theta$ is the phase angle difference)

In the ISB system:

$$f(t) = \frac{1+M\cos\theta}{1+0.5m\cos\theta}\cdot\sin\left(m\sin\theta\,\frac{1+m_t m\cos\theta}{1+m\cos\theta}\right) \quad (17)$$

where $m_t$ is a constant set at the broadcast side.

The calculated results of the distortion factor and the separation obtained by Fourier-developing the above expressions relating to the AM-PM, C-QUAM, and VCPM systems are as follows:

| | |
|---|---|
| AM-PM system: | 3.5%, 20 dB or more |
| C-QUAM system: | 3.5%, 20 dB or more |
| VCPM system: | 1.2%, 16 dB |

From the above, it can be understood that if a distortion factor of approximately 5% and a degree of separation of approximately 20 dB can be tolerated on the AM-PM, C-QUAM, and VCPM systems, then only the ISB broadcast signals require switching, and the stereo broadcast signals of the other systems can be received in an acceptable fashion.

Based on the above, and according to the present invention, it is seen that the same AM receiver can be adapted to receive the ISB system AM stereo broadcast signals as the fundamental system and also to receive the AM-PM, C-QUAM, and VCPM system signals without any additional demodulating circuits. Nevertheless, it does require switching the demodulating circuit upon receiving the ISB system signals to provide a distortion factor and separation sufficient to produce the desired stereo effect. Therefore, the AM stereo receiver embodying the present invention can be seen to be quite simple in circuit construction, and therefore, relatively inexpensive yet can still receive the AM stereo signals transmitted according to various ones of the different AM stereo systems.

In regard to the switch arrangement used, in the embodiment of FIG. 2, to change the demodulating circuit, it is to be understood that this switch can be any conventional type of switch, such as a manual switch, or an automatic switch, which is automatically switched by detecting the pilot signal of the particular type of stereo modulation system, or the switch can be included in the tuning section so that the switching information is memorized in a station memory and when a particular station is selected, the appropriate switch actuation is carried out.

Although a single preferred embodiment, of the invention has been described in detail herein with reference to the drawings, it is to be understood that the invention is not limited to that precise embodiment, and that many modifications and variations could be effected therein by one skilled in the art without departing from the spirit or scope of the invention, whereby the scope of the invention, as defined by the appended claims.

What is claimed is:

1. Apparatus for decoding left channel signals and right channel signals from AM stereo signals coded according to any of several known methods, comprising:

envelope detecting means responsive to said AM stereo signals for producing stereo sum signals formed of the sum of the left channel signals and the right channel signals;

synchronous detecting means responsive to said AM stereo signals for producing stereo difference signals formed of the difference between the left channel signals and the right channel signals;

selective phase shift means connected to receive said stereo sum signals and said stereo difference signals for selectively producing either a first output signal pair formed of said stereo sum signals and said stereo difference signals or a second output signal pair formed of said stereo sum signals and said stereo difference signals each shifted in phase by a predetermined amount; and matrix means connected to said selective phase shift means to receive either said first output signal pair or said second output signal pair for producing left channel signals and right channel signals therefrom.

2. Apparatus according to claim 1, further comprising amplitude limiting means connected to said AM stereo signals for producing therefrom AM stereo signals of substantially constant amplitude fed to said envelope detecting means.

3. Apparatus according to claim 1, in which said envelope detecting means includes a phase-locked loop.

4. Apparatus according to claim 1, further comprising divisor generating means responsive to said stereo sum signals from said envelope detecting means for generating divisor signals fed to signal divider means connected to divide said AM stereo signals by said divisor signals for producing a divided output signal fed to said synchronous detecting means.

5. Apparatus according to claim 4, in which said envelope detecting means includes a phase-locked loop and said synchronous detecting means is arranged for multiplying the output of said signal divider means with the output of said phase-locked loop to produce said stereo difference signals.

6. Apparatus according to claim 4, in which said divisor generating means includes voltage divider means, whereby said divisor signals are represented as $1+0.5(L+R)$, where $L+R$ is the stereo sum signal.

7. Apparatus according to claim 1, in which said selective phase shift means includes output switch means for selecting either said first output signal pair or said second output signal pair.

8. Apparatus according to claim 1, in which said selective phase shift means includes means for shifting the phase of said sum signal to a 45° phase lag and for shifting the phase of said difference signal to a 45° phase lead, to form said second output signal pair therefrom.

9. Apparatus for use in an AM stereo receiver for decoding into left channel (L) signals and right channel (R) signals AM stereo signals that have been coded by one of several different known methods, comprising:

synchronous detector means responsive to said coded AM stereo signals for producing therefrom stereo difference signals $(L-R)$;

envelope detector means responsive to said coded AM stereo signals for producing therefrom stereo sum signals $(L+R)$;

phase shift means connected to said stereo sum signals and stereo difference signals for imparting a predetermined phase shift thereto and producing phase-shifted stereo sum signals and phase-shifted stereo difference signals;

matrix means; and switch means arranged to selectively connect either said stereo sum and difference signals or said phase-shifted stereo sum and difference signals to said switching matrix means, said switching matrix means being operative for separating the left channel signal and the right channel signal from signals fed thereto.

10. Apparatus according to claim 9, further comprising amplitude limiting means connected to said AM stereo signals for producing therefrom AM stereo signals of substantially constant amplitude fed to said envelope detector means.

11. Apparatus according to claim 9, in which said envelope detector means includes a phase-locked loop.

12. Apparatus according to claim 9, further comprising divisor means responsive to said stereo sum signals produced by said envelope detector means for generating therefrom a divisor signal fed to signal divider means connected to divide said AM stereo signals by said divisor signal for producing a divided output signal fed to said synchronous detector means.

13. Apparatus according to claim 12, in which said envelope detector means includes a phase-locked loop and said synchronous detector means is arranged for multiplying the output of said signal divider by the output of said phase-locked loop for producing said stereo difference signal.

14. Apparatus according to claim 12, in which said divisor means includes circuit means whereby said divisor signal is represented by $1+0.5(L+R)$.

15. Apparatus according to claim 9, in which said phase shift means includes means for shifting the phase of said stereo sum signals to a 45° phase lag and shifting the phase of said difference signal to a 45° phase lead.

16. A method for decoding left channel and right channel signals from AM stereo signals that have been coded according to one of several known methods, comprising the steps of:

producing stereo sum signals formed of the sum of the left channel and right channel signals;

producing stereo difference signals formed of the difference between the left channel and right channel signals;

phase shifting the produced stereo sum signals and the produced stereo difference signals; and selectively connecting either said stereo sum signals and said stereo difference signals or said phase-shifted stereo sum signals and said phase-shifted stereo difference signals to a matrixing circuit.

17. A method according to claim 16, in which the step of phase shifting the stereo sum signals includes the step of shifting the phase to lag by 45° and the step of phase shifting the stereo difference signals includes the step of shifting the phase to lead by 45°.

18. A method according to claim 16, in which the step of producing the stereo sum signals includes the step of detecting the envelope of the coded AM stereo signals.

19. A method of claim 18, wherein the step of detecting the envelope of the AM coded stereo signals includes the step of producing a phase-locked signal locked in phase to the AM stereo signals.

20. A method according to claim 18, in which the step of detecting the envelope includes a preceding step of limiting the amplitude of the AM stereo signals to a substantially constant level.

21. A method according to claim 16, in which the step of producing stereo difference signals includes the step of synchronously detecting the coded AM stereo signals.

22. A method according to claim 21, in which the step of synchronously detecting includes the step of dividing the AM stereo signals by a predetermined divisor signal.

23. A method according to claim 21, further including the steps of generating a predetermined divisor signal and feeding the predetermined divisor signal to a signal divider, connecting the signal divider to divide the AM stereo signals by the predetermined divisor signal and connecting the resultant signal for synchronous detection.

24. A method according to claim 23, further comprising the step of detecting the envelope of the coded AM stereo signals, said step of detecting the envelope of the coded AM stereo signals including producing a phase-locked signal locked in phase with the AM stereo signals and multiplying the output of the signal divider by the phase-locked signal to produce the stereo difference signals.

25. A method according to claim 23, in which the step of generating the divisor signal includes generating a weighted divisor signal represented by $1+0.5(L+R)$, where $(L+R)$ is the stereo sum signal.

* * * * *